US007882809B2

(12) United States Patent
Lomax, Jr. et al.

(10) Patent No.: US 7,882,809 B2
(45) Date of Patent: Feb. 8, 2011

(54) HEAT EXCHANGER HAVING A COUNTERFLOW EVAPORATOR

(75) Inventors: Franklin D. Lomax, Jr., Falls Church, VA (US); Christopher Van Dyke, Washington, DC (US); Edward T. McCullough, Dallas, TX (US)

(73) Assignee: L'Air Liquide, Societe Anonyme pour l'Etude Et l'Exploitation des Procedes Georges Claude, Paris (FR)

( * ) Notice: Subject to any disclaimer, the term of this patent is extended or adjusted under 35 U.S.C. 154(b) by 861 days.

(21) Appl. No.: 11/557,180

(22) Filed: Nov. 7, 2006

(65) Prior Publication Data

US 2008/0104960 A1 May 8, 2008

(51) Int. Cl.
*F22G 3/00* (2006.01)
*F22B 37/28* (2006.01)

(52) U.S. Cl. ..... 122/459; 122/460; 165/159

(58) Field of Classification Search ..... 122/235.15, 122/235.17, 364, 459, 460, 467, 470, 471, 122/1 B, 406.4, 7 R; 165/145, 159
See application file for complete search history.

(56) References Cited

U.S. PATENT DOCUMENTS 2,669,976 A * 2/1954 Frisch ..... 122/459
3,301,224 A * 1/1967 Ambrose ..... 122/406.4
3,872,836 A * 3/1975 Gorzegno et al. ..... 122/406.4
4,282,926 A 8/1981 Holland
5,056,468 A * 10/1991 Wittchow et al. ..... 122/451 S
5,284,029 A * 2/1994 Keuper et al. ..... 62/476
5,426,955 A * 6/1995 Modahl ..... 62/497
5,626,103 A 5/1997 Haws et al.
5,787,844 A 8/1998 Paju
6,173,679 B1 * 1/2001 Bruckner et al. ..... 122/406.4
6,957,695 B2 10/2005 Lomax, Jr. et al.
7,017,529 B1 3/2006 Lomax, Jr. et al.
7,637,233 B2 * 12/2009 Albrecht et al. ..... 122/467
2004/0069244 A1 * 4/2004 Schroeder ..... 122/406.4
2005/0194120 A1 9/2005 Lomax, Jr. et al.

* cited by examiner

*Primary Examiner*—Gregory A Wilson
(74) *Attorney, Agent, or Firm*—Elwood L. Haynes

(57) ABSTRACT

An evaporator including a lower drum, an upper drum, and at least one tube extending between the lower drum and the upper drum. The plurality of tubes have fluid passageways therein extending from the lower drum to the upper drum. A duct is provided having a heating gas passageway provided therein. The at least one tube extends through the heating gas passageway. The fluid passageways define an overall flow path from the lower drum to the upper drum extending in a direction substantially counter-current to an overall flow path defined by the heating gas passageway extending from a gas inlet of the heating gas passageway to a gas outlet thereof.

21 Claims, 4 Drawing Sheets

HEAT EXCHANGER HAVING A COUNTERFLOW EVAPORATOR

BACKGROUND OF THE INVENTION

1. Field of the Invention

The present invention relates to a heat exchanger that includes a counterflow evaporator.

2. Discussion of the Background

Heat exchangers that include evaporators heated by hot gases typically suffer from relatively large size and high cost. Further, evaporators that generate steam at a single pressure typically exhibit poor thermal efficiency because the hot gas contacts the tubing conveying the liquid being evaporated in a cross-flow or parallel flow configuration at a single temperature, the saturation temperature at the pressure of interest. While previous systems and methods have attempted to improve upon steam boiler control and construction, these systems and methods still suffer from the drawback of cross-flow contact between the heating gas and the evaporating liquid.

SUMMARY OF THE INVENTION

In an effort to eliminate the above drawbacks of related art heat exchangers that include evaporators, the inventors have constructed a heat exchanger that includes a counter-flow evaporator as described below.

The present invention advantageously provides an evaporator including a lower drum, an upper drum, and a plurality of tubes extending between the lower drum and the upper drum. The tubes have fluid passageways therein extending from the lower drum to the upper drum. A duct is provided having a heating gas passageway provided therein. The plurality of tubes extends through the heating gas passageway. The fluid passageways define an overall flow path from the lower drum to the upper drum extending in a direction substantially counter-current to an overall flow path defined by the heating gas passageway extending from a gas inlet of the heating gas passageway to a gas outlet thereof.

The present invention also advantageously provides a heat exchanger including, in addition to the above evaporator, a superheater having a superheater heating gas passageway therein extending from a superheater gas inlet to a superheater gas outlet, where the superheater has at least one superheater tube having a superheater fluid passageway therein extending from a superheater fluid inlet to a superheater fluid outlet. The at least one superheater pipe extends through the superheater heating gas passageway. Additionally, an economizer is provided having an economizer heating gas passageway therein extending from an economizer gas inlet to an economizer gas outlet, where the economizer has at least one economizer tube having an economizer fluid passageway therein extending from an economizer fluid inlet to an economizer fluid outlet. The at least one economizer pipe extends through the economizer heating gas passageway. Furthermore, the superheater heating gas outlet is connected to the heating gas inlet of the evaporator, the heating gas outlet of the evaporator is connected to the economizer heating gas inlet, the economizer fluid outlet is connected to the lower drum of the evaporator, and the upper drum of the evaporator is connected to the superheater fluid inlet.

The present invention further advantageously provides a method of generating steam including providing a fluid flowing from a lower drum through a plurality of tubes to an upper drum, and providing a heated gas flowing from a gas inlet of a heating gas passageway to a gas outlet of the heating gas passageway such that the heated gas contacts the plurality of tubes and heats the fluid within the plurality of tubes from liquid-phase to gaseous-phase. In this method, the fluid flows through the plurality of tubes in a substantially counter-current direction to an overall flow path of the heated gas flowing from the gas inlet of the heating gas passageway to the gas outlet of the heating gas passageway.

Furthermore, the present invention advantageously provides a method of super heating steam including providing an economizer having a fluid flowing within at least one economizer pipe from an economizer fluid inlet to an economizer fluid outlet, and providing a evaporator having a lower drum connected through a plurality of tubes to an upper drum, where the lower drum receives the fluid from the economizer fluid outlet, and the fluid flows from the lower drum through the plurality of tubes to the upper drum. The method also includes providing a superheater having at least one superheater pipe with a superheater fluid inlet and a superheater fluid outlet, where the superheater fluid inlet receives the fluid from the upper drum of the evaporator, and providing a heated gas flowing through a heating gas passageway extending through the superheater, the evaporator, and the economizer, such that the heated gas contacts the at least one superheater pipe, the plurality of tubes, and the at least one economizer pipe. In this method, the fluid flows through the plurality of tubes of the evaporator in a substantially counter-current direction to an overall flow path of the heated gas flowing through the evaporator.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE INVENTION

Figure 2:
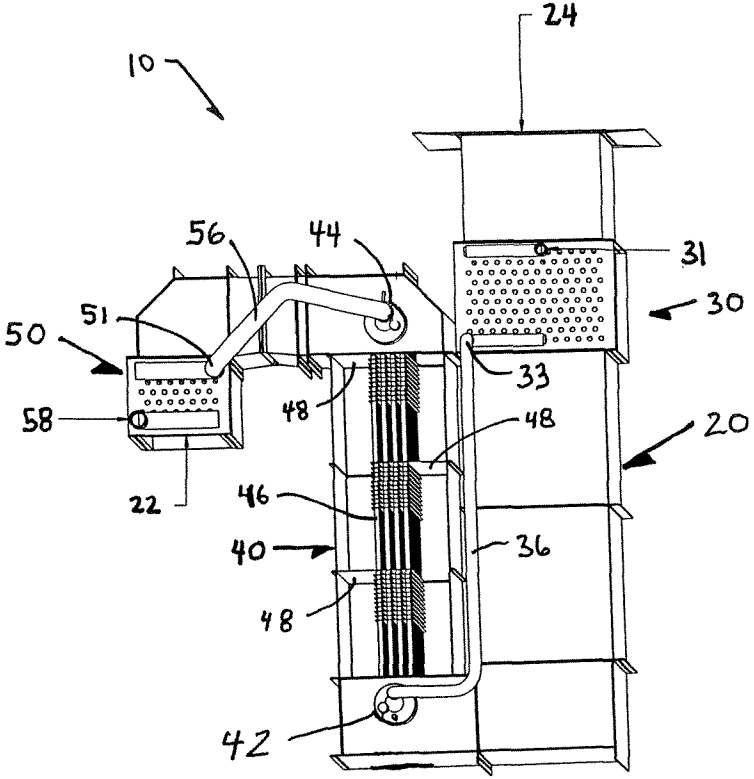
FIG. 2 is a perspective view of the heat exchanger of the present invention, where the front panels along duct 26 are removed to reveal the evaporator.

Embodiments of the present invention will be described hereinafter with reference to the accompanying drawings. In the following description, the constituent elements having substantially the same function and arrangement are denoted by the same reference numerals, and repetitive descriptions will be made only when necessary.

Figure 1:
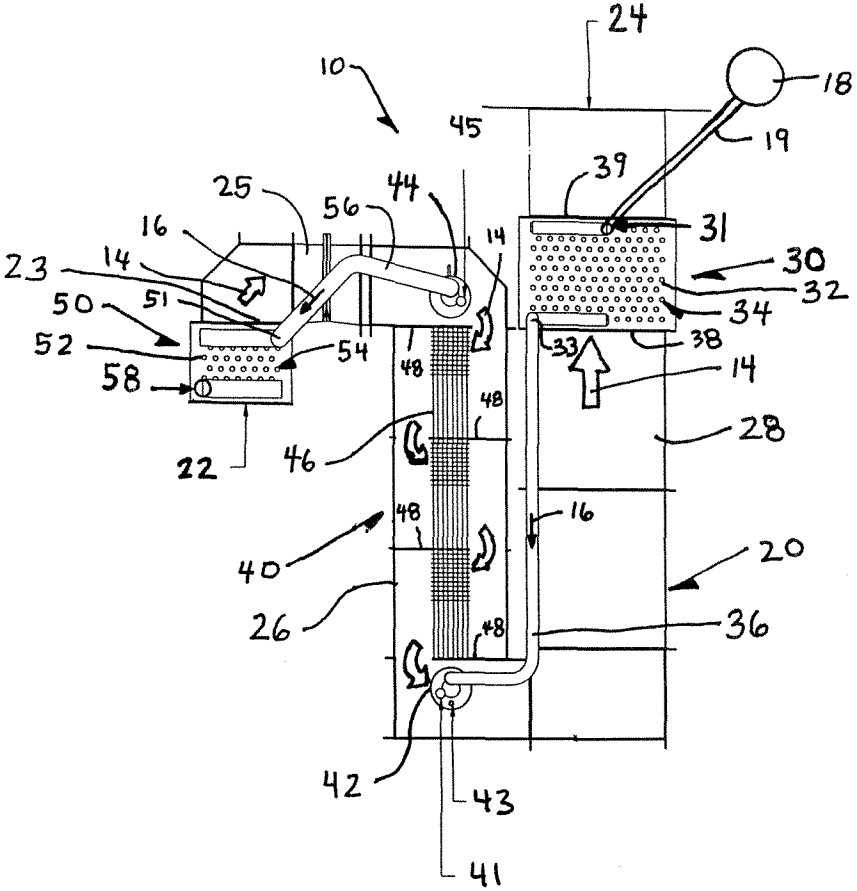
FIG. 1 is a front elevational view of a heat exchanger of the present invention connected to a evaporating fluid supply pump, where front panels along duct 26 are removed to reveal a evaporator.

As depicted in FIGS. 1 and 2, the heat exchanger 10 of the present invention includes at least an evaporator 40. Alternatively, the heat exchanger 10 can also be provided with a first coil (referred to as an "economizer") 30 to heat the evaporating fluid 16, which begins in a liquid phase, to a temperature below the boiling (saturation) temperature. The evaporating fluid 16 is pumped to the economizer 30 via a supply pipe 19 by a pump 18, and the evaporating fluid travels through a series of tubes 32 that extend across a portion of duct 20 of the heat exchanger upstream of an outlet 24 of the duct 20 carrying the heating gas 14 from the heating gas inlet. The tubes 32 extend across the duct 20 in an array 34, and the tubes can extend in a single pass arrangement or in a multi-pass serpentine manner back and forth across the economizer, in order to achieve the desired heat exchange between the heating gas and the evaporating fluid. Likewise, one continuous evaporating fluid path may exist between the inlet and outlet, or more than one path may be provided in parallel. The configuration of tubes 32 used preferably provide an overall counter flow arrangement between the flow direction of the heating gas flowing through the economizer 30 (bottom to top in FIG. 1) from heating gas inlet 38 to heating gas outlet 39, as compared to the flow direction of the evaporating fluid flowing through the economizer (top to bottom in FIG. 1) from evaporating fluid inlet 31 to evaporating fluid outlet 33. The economizer 30 heats the evaporating fluid 16 from a temperature at which the evaporating fluid is supplied to the heat exchanger at the supply pipe to a temperature below the boiling temperature. This advantageously prevents the formation of vapor inside the evaporating fluid passages of the economizer. When the formation of gas in the economizer is prevented, a smaller flow area of the evaporating fluid passages may be employed for a given maximum pressure drop.

Once the evaporating fluid 16 is heated by the economizer 30, then the heated evaporating fluid is transported via pipe 36 past duct section 28 to a second coil (referred to as a "evaporator") 40. Alternatively, all of the heating from the temperature of the evaporating fluid supply 19 to the evaporator exit temperature may be achieved in the evaporator 40. The evaporator 40 includes a lower drum 42, which receives the heated evaporating fluid via pipe 36, an upper drum 44, and a series of tubes 46 having fluid passageways therein that extend between the lower drum 42 and the upper drum 44. In one embodiment, the evaporator 40 does not raise the temperature of the evaporating fluid to any large extent, but rather takes care of the phase change of the evaporating fluid from liquid to gas. In this embodiment, the economizer 30 raises the evaporating fluid temperature close to the saturation temperature. Preferably, the economizer 30 will have a lower evaporating fluid flow area than the evaporator 40, such that either fewer tubes flow in parallel in the economizer and/or those tubes are of a smaller diameter. This embodiment maximizes the heat transfer rate to the evaporating fluid in the economizer 30 and the evaporator 40, respectively.

The lower drum 42 preferably includes a temperature sensor 41 for use in monitoring and controlling the operation of the system, and a blowdown port 43. The upper drum 44 also preferably includes a temperature sensor 45 for use in monitoring and controlling the operation of the system according to the method of U.S. Pat. No. 7,017,529, which is incorporated herein in its entirety. The system can, optionally, be provided with one or more level sensing means connected to one or more of the drums 42 and 44 for control according to traditional methods. In the embodiment where little temperature change occurs across the evaporator 40, a liquid recirculation means can also be provided to transport evaporating fluid from the upper drum 44 to the lower drum 42, in order to assure a constant level and temperature of liquid in the evaporator tubes 46.

The tubes 46 of the evaporator 40 extend through duct section 26, which has a heating gas passageway therein to carry the heating gas 14 that extends from a heating gas inlet adjacent the upper drum 44 to a heating gas outlet adjacent the lower drum 42. Under typical operation, the evaporating fluid is in the liquid phase in the lower drum 42 and in the gas phase in a discharge pipe 56 from the upper drum 44. The evaporating fluid is present within the tubes 46, and absorbs heat from the heating gas 14 traveling over the outside of the tubes 46. The flow of the heating gas 14 through the evaporator 40 is in an overall counter-current direction as compared to the flow of the evaporating fluid 16 traveling through the evaporator. In other words, the heating gas 14 is traveling through the evaporator 40 in a downward vertical direction in the embodiment in FIG. 1, while the evaporating fluid 16 is traveling through the evaporator 40 in an upward vertical direction. The evaporator 40 includes at least one baffle 48 within the duct section 26 in order to force the heating gas 14 to cross the tubes 46 as the heating gas 14 travels through the evaporator 40. The velocity of the heating gas is necessarily higher than it would be if the heating gas flowed across the tubes 46 directly in cross flow. This increased velocity results in increased heat transfer rate compared to the case of single-pass cross flow, thus reducing the size of the evaporator 40. Further, if the temperature in the inlet drum 42 is below the saturation temperature, the separation of the heating gas flow into more than one sequential, cross-flow step allows for a more efficient heat transfer between the cooled heating gas and the evaporating fluid. In the embodiment shown in the figures, the spacing between the baffles 48 is constant. In another embodiment of the present invention, the spacing of the baffles is varied. For example, the spacing can be reduced in proportion to the temperature drop of the heating fluid, in order to keep the inlet velocity of the fluid constant at the beginning of each cross-flow pass. The optimization of the baffle spacing to achieve this or other optimization criteria is known in the art of heat transfer.

In one embodiment of the present invention, the baffles 48 are spaced to maintain a maximum heating gas velocity through the tube bundle greater than 3 meters per second. In another embodiment, the baffles 48 are spaced to maintain a maximum heating gas velocity through the tube bundle greater than 6 meters per second.

In one embodiment of the present invention, the evaporating fluid 16, which is now in the gaseous form, is transferred from the upper drum 44 to a third coil (referred to as a "superheater") 50 via a pipe 56. The superheater 50 brings the evaporating fluid to its final temperature, which can be any temperature above the saturation temperature, but below the maximum service temperature of the superheater materials of construction. In the superheater 50, the evaporating fluid enters through an inlet 51 and travels through a series of tubes 52 that extend across a portion of duct 20 of the heat exchanger adjacent an inlet 22 of the duct 20 carrying the heating gas 14 from a heat source. The tubes 52 extend across the duct 20 in an array 54, and the tubes can extend in a single pass arrangement or in a multi-pass serpentine manner back and forth across the superheater, in order to achieve the desired heat exchange between the heating gas and the evaporating fluid. Likewise, one continuous evaporating fluid path can exist between the inlet and outlet, or two or more paths can be provided in parallel. The configuration of tubes 52 used preferably provide an overall counter flow arrangement between the flow direction of the heating gas flowing through the superheater 50 (bottom to top in FIG. 1) from heating gas inlet 22 to heating gas outlet 23, as compared to the flow direction of the evaporating fluid flowing through the superheater (top to bottom in FIG. 1) from evaporating fluid inlet 51 to evaporating fluid outlet 58. Once the evaporating fluid 16 is heated by the superheater 50 to its final temperature, then the heated evaporating fluid exits the superheater 50 via outlet 58.

Overall the three coils of the embodiment depicted in FIG. 1 are arranged so that the heating gas 14 first reaches the superheater 50, then the evaporator 40, and finally the economizer 30 through duct 20, which includes duct sections 25, 26, and 28. This configuration provides a counter flow arrangement that allows the hottest heating gas to heat the hottest evaporating fluid. Furthermore, internally each coil is run in a counter flow configuration. Such a counter flow arrangement for an evaporator is unique. In the steam generator of the present invention and in other designs, the fluid passageways for the process liquid being evaporated are oriented substantially upright, such that evaporated evaporating fluid separate from the denser liquid phase by gravity. In other designs, the heating gas is also generally caused to flow upwards locally, such that the heating gas's flow is assisted by gravity buoyancy effects. However, in the present invention, the heating gas is directed downward through the evaporator, and baffles are used to enhance heat transfer within the evaporator by causing the heating gas to increase in velocity. This configuration allows the evaporator to be internally counter flow in nature and has the added benefit of reducing the overall size of the unit.

Figure 3:
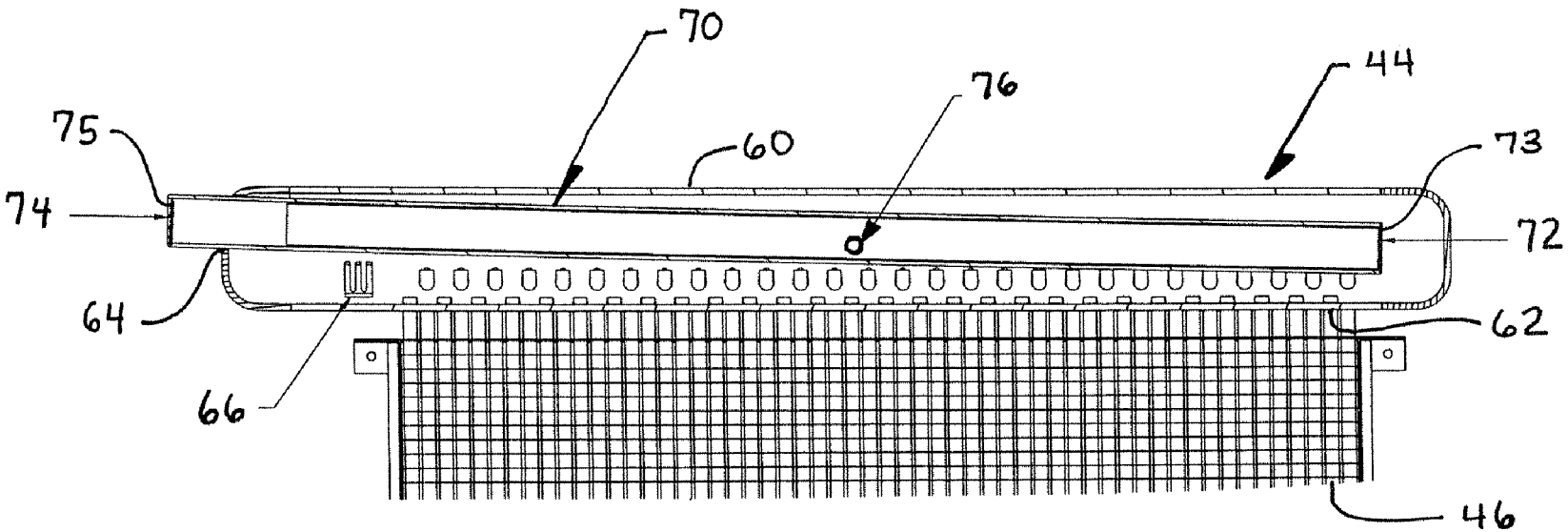
FIG. 3 is a cross-sectional view of an upper boiler drum and a portion of boiler tubes of the evaporator.

The evaporator 40 preferably includes a structure for removing droplets from the evaporating fluid exiting the evaporator 40. The present invention includes a mist eliminator within the upper boiler drum 44, as depicted in FIG. 3. The mist eliminator includes a housing 60 with holes 62 provided on the bottom surface thereof. The tubes 46 extend through the holes 62 and discharge the evaporating fluid within the housing 60. This evaporating fluid contains both liquid phase and vapor phase material. Packings 66 (only one packing is shown for clarity) substantially fill the housing 60. The packings 66 are preferably sized such that they will not fall into the open ends of the boiler tubes 46. Alternatively, the packings can be replaced by a structured media, such as layers of wire mesh, expanded metal screen, metal or ceramic foam, or other materials having a substantial surface area per unit volume.

The mist eliminator further includes a mist eliminator pipe 70 that is provided within the housing 60 in an inclined manner such that a lower inlet end 72 is within the housing and pipe 70 extends through an opening 64 in the housing 60 such that an upper outlet end 74 is outside of the housing 60. The mist eliminator pipe 70 has packings 76 (only one packing is shown for clarity) fully packed therein. Alternatively, the packings 76 can be replaced by a structured media, as in the case of the packings 66. In the embodiment employing individual packings 76, the mist eliminator pipe 70 preferably is provided with a mesh or perforated plate 73 welded to the lower inlet end 72 in order to retain the packings 76 within the pipe 70, and a mesh or perforated plate 75 welded to the upper outlet end 74 in order to prevent the evaporating fluid flow from carrying the packings 76 out of the pipe 70. The velocity of the steam evaporating fluid is typically well below fluidization velocity of the packings; however, it is preferable to provide such mesh or perforated plates in order to prevent the packings from being carried out by the steam evaporating fluid flow.

In this bed within a bed configuration, the mixed-phase evaporating fluid enters the housing 60 from the tubes 46, enters the lower inlet end 72 of the mist eliminator pipe 70, and then exits the upper outlet end 74, which is fluidly connected to pipe 56. The packings 66 are intended to intercept and coalesce the majority of liquid-phase droplets that may be present within the evaporating fluid exiting from the tubes 46 of the evaporator. The packings 76 within the mist eliminator pipe 70 provide for further capture and elimination of droplets that may have made it passed the first set of packings.

In one embodiment of the present invention, the cross sectional area of the pipe 70 is smaller than the cross sectional area available for fluid flow in the housing (or shell) 60. In one embodiment of the present invention, all of the packings 76 and 66 are similar in characteristic size. In another embodiment of the present invention, the packings 66 possess a larger characteristic size than the packings 76. In another embodiment of the present invention, the packings 76 possess varying characteristic size from the inlet end 72 to the discharge end 74. In one embodiment of the present invention, the velocity of the gas phase evaporating fluid through the pipe 70 is below the droplet entrainment velocity (or "superficial velocity," which is a velocity of flow if the pipe were empty (i.e., no media), and at which droplet shear within the pipe occurs) for the evaporating fluid in question. In another embodiment of the present invention, when the evaporating fluid is water, the velocity in the pipe 70 is below 5 m/sec. In another embodiment of the present invention, when the evaporating fluid is water, the velocity in the pipe 70 is below 3 m/sec. Such velocities may be necessary to prevent droplet shear within the pipe 70 in conjunction with a desired maximum velocity of heating gas through the bundle of tubes 46.

Figure 4:
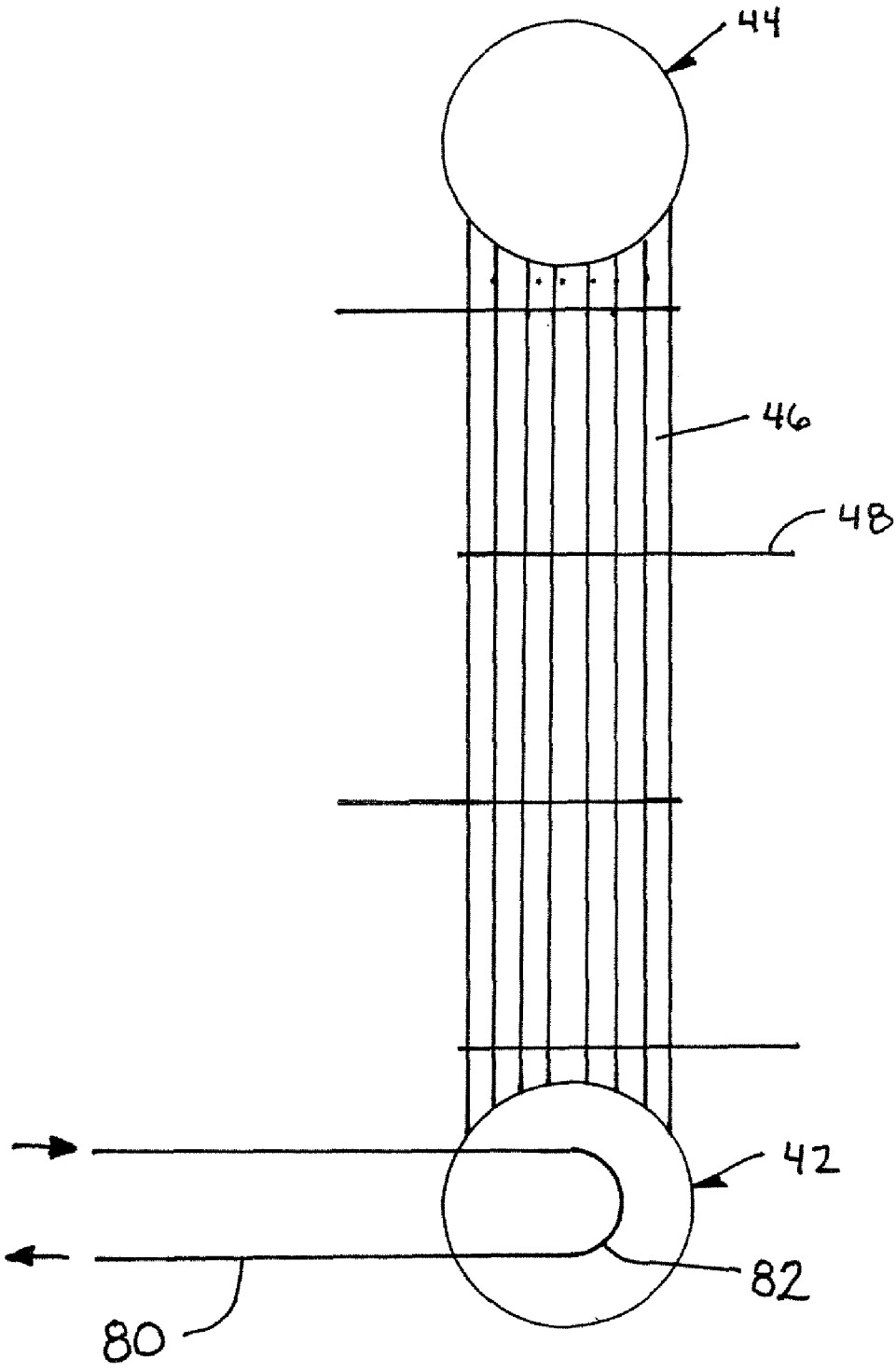
FIG. 4 is a schematic drawings of an alternative embodiment of a evaporator of the present invention.

FIG. 4 depicts an alternative embodiment of the evaporator of the present invention. In this embodiment, the lower boiler drum 42 is provided with a supplemental heat transfer coil 82. The heat transfer coil 82 is fed by a heat transfer fluid circuit 80 that provides a secondary source of heat to the evaporator, and thereby allows for a reduction in the energy transfer required from the heating gas to vaporize a fixed flowrate of evaporating fluid. This reduction in energy can advantageously be used to reduce the discharge temperature of the heating gas, to reduce the flowrate of heating gas required, or to achieve a combination of these goals. This can materially reduce the heat losses in the cooled heating gases exiting the economizer.

Figure 5:
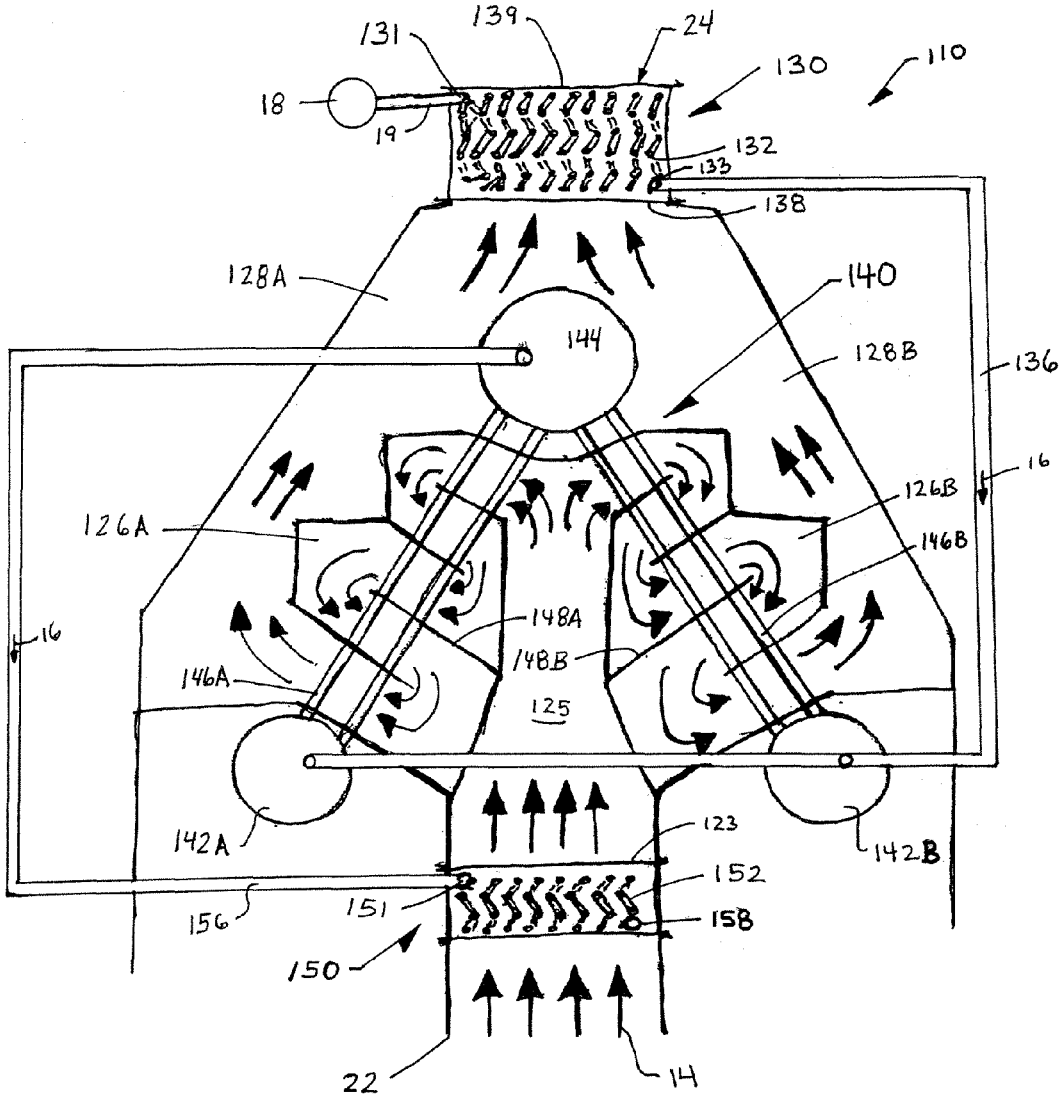
FIG. 5 is a partial cross-sectional view of an alternative embodiment of the heat exchanger of the present invention.

FIG. 5 depicts an alternative embodiment of the heat exchanger 110 of the present invention, which also includes a three coil configuration. The alternative embodiment has an inverted V-shaped evaporator, which provides evaporator with the advantages of the present invention having a lower total height.

The first coil (referred to as an "economizer") 130 heats the evaporating fluid 16, which begins in a liquid phase, to a temperature below the boiling temperature. The evaporating fluid 16 is pumped to the economizer 130 via a supply pipe 19 by a pump 18, and the evaporating fluid travels through a series of tubes 132 that extend across a portion of duct 125 of the heat exchanger upstream of an outlet 124 of the duct 125 carrying the heating gas 14 from a heat source. The configuration of tubes 132 used preferably provide an overall counter flow arrangement between the flow direction of the heating gas flowing through the economizer 130 (bottom to top in FIG. 5) from heating gas inlet 138 to heating gas outlet 139, as compared to the flow direction of the evaporating fluid flowing through the economizer (top to bottom in FIG. 5) from evaporating fluid inlet 131 to evaporating fluid outlet 133

Once the evaporating fluid 16 is heated by the economizer 130, then the heated evaporating fluid is transported via pipe 136 to a second coil (referred to as an "evaporator") 140. The evaporator 140 includes two lower drums 142A and 142B, which receive the heated evaporating fluid via pipe 136, and an upper drum 144. Alternatively, it should be appreciated that a single lower drum 142 and multiple upper drums 144 can be provided. In fact, embodiments having a number of upper and lower drums operated in parallel are possible with greatly-reduced height compared to the embodiment depicted in FIG. 1.

In the embodiment of FIG. 5, a first series of tubes 146A extend between the lower drum 142A and the upper drum 144, and a second series of tubes 146B extend between the lower drum 142B and the upper drum 144. Temperature sensors and blowdown ports can be provided in the lower boiler drums 142A and 142B, and a temperature sensor can be provided in the upper boiler drum 144 for use in monitoring and controlling the operation of the system. Likewise, traditional level controls and/or recirculation piping may be provided as in the case of the embodiment of FIG. 1. Note that the blowdown ports of the lower boiler drums can be operated alternately in order to reduce interruption to steam generation, or blowdown can be carried out simultaneously to both lower boiler drums through one or more valves.

The tubes 146A and 146B of the evaporator 140 extend through duct sections 126A and 126B, respectively, which carry the heating gas 14. Under typical operation, the evaporating fluid is in the liquid phase in the lower boiler drums 142A and 142B and in the gas phase exiting the upper drum 144. The flow of the heating gas 14 through the evaporator 140 is in an overall counter flow direction as compared to the evaporating fluid 16 traveling through the evaporator. In other words, the heating gas 14 is traveling through the evaporator 140 in an overall downward direction in the embodiment in FIG. 5, while the evaporating fluid 16 is traveling through the evaporator 140 in an overall upward direction. The evaporator 140 includes one or more baffles 148A and 148B within the duct sections 126A and 126B, respectively, in order to force the heating gas 14 to cross the tubes 146A and 146B as the heating gas 14 travels through the evaporator, thereby increasing the heat transfer between the heating gas and the evaporating fluid.

The evaporating fluid 16, which is now in the gaseous form, is transferred from the upper drum 144 to a third coil (referred to as a "superheater") 150 via a pipe 156. The superheater 50 brings the evaporating fluid to its final temperature above the saturation temperature. In the superheater 150, the evaporating fluid enters through an inlet 151 and travels through a series of tubes 152 that extend across a portion of duct 125 of the heat exchanger adjacent an inlet 22 of the duct 125 carrying the heating gas 14. The configuration of tubes 152 used preferably provide an overall counter flow arrangement between the flow direction of the heating gas flowing through the superheater 150 (bottom to top in FIG. 5) from heating gas inlet 22 to heating gas outlet 123, as compared to the flow direction of the evaporating fluid flowing through the superheater (top to bottom in FIG. 5) from evaporating fluid inlet 151 to evaporating fluid outlet 158.

Once the evaporating fluid 16 is heated by the superheater 150 to its final temperature, then the heated evaporating fluid is discharged from outlet 158.

The embodiment depicted in FIG. 5 is self insulating. In this configuration, the hottest part of the system (i.e. the superheater 150) is position inside of the heat exchanger. Since the evaporator 140 is the next hottest part of the system, the amount of insulation needed for the superheater is advantageously reduced. Additionally, the evaporator is inside of the ducting that directs the heating gas to the economizer, and so the ducting insulates the evaporator. In a standard linear arrangement of these components, it is usually necessary to insulate the superheater against the ambient environment and insulate the boiler against the ambient environment. In the embodiment in FIG. 5, it is only typically necessary to insulate the gas exiting the evaporator against the ambient environment. This gas is at an advantageously lower temperature than in the embodiment of FIG. 1.

The embodiment in FIG. 5 can be modified within the scope of the invention, for example, by incorporating various extended heat transfer surfaces, such as heat transfer fins, within the evaporator, economizer and/or superheater. The embodiment could also be modified such that the tubes 146A and 146B are oriented in a vertical orientation, or at different angles than shown. Additionally, the embodiment can be modified to include a V-shaped evaporator with a single lower boiler drum and two upper boiler drums, and modification of the ducting in order to achieve the counter current flow through the evaporator. Also, note that the economizer could be split into two economizers in the embodiment depicted in FIG. 5, such that each economizer receives heating gas from a different side of the inverted V-shaped evaporator.

The present invention provides a system that allows for efficient heat transfer due to the overall counter-current flow. The present invention also allows for minimized size by controlling the Reynold's number of the heating gas across the liquid-conveying tubes of the evaporator independent of the tube array depth or total heat transfer area. The present invention also allows for minimized depth of the tube array (number of rows of tubes in the array) as well as more uniform temperatures in the tubes, thus advantageously reducing thermal stresses as compared to an overall cross-flow configuration.

The present invention can be constructed using a housing and seal configuration as taught in U.S. Pat. No. 6,957,695 in order to further accommodate thermal expansion with a sealing ductwork.

It should be noted that the exemplary embodiments depicted and described herein set forth the preferred embodiments of the present invention, and are not meant to limit the scope of the claims hereto in any way.

Numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method of generating steam comprising: providing a fluid flowing from a lower drum through at least one tube to an upper drum; providing a heated gas flowing from a gas inlet of a heating gas passageway to a gas outlet of the heating gas passageway such that the heated gas contacts the at least one tube and heats the fluid within the at least one tube from liquid-phase to gaseous-phase, wherein the fluid flows through the at least one tube in a substantially counter-current direction to an overall flow path of the heated gas flowing from the gas inlet of the heating gas passageway to the gas outlet of the heating gas passageway, further comprising providing a secondary heat transfer coil within the lower drum to heat the fluid within the lower drum.

2. A method of generating steam comprising: providing a fluid flowing from a lower drum through at least one tube to an upper drum; providing a heated gas flowing from a gas inlet of a heating gas passageway to a gas outlet of the heating gas passageway such that the heated gas contacts the at least one tube and heats the fluid within the at least one tube from liquid-phase to gaseous-phase, wherein the fluid flows through the at least one tube in a substantially counter-current direction to an overall flow path of the heated gas flowing from the gas inlet of the heating gas passageway to the gas outlet of the heating gas passageway, further comprising providing a mist eliminator at the upper drum to remove liquid droplets suspended in the gaseous phase of the fluid as the fluid travels through the upper drum.

3. The method according to claim 2, wherein the mist eliminator includes: a housing; a mist eliminator pipe provided within the housing at an incline, the mist eliminator pipe having a lower inlet end provided within the housing and an upper outlet end extending outside of the housing; first coalescing media provided within the housing; and second coalescing media provided within the mist eliminator pipe.

4. The method according to claim 3, wherein the mist eliminator pipe is provided with a smaller cross sectional flow area than a cross sectional flow area in the housing.

5. The method according to claim 3, wherein a velocity of gas traveling through the mist eliminator pipe is maintained below a droplet entrainment velocity.

6. The method according to claim 3, wherein a velocity of gas traveling through the mist eliminator pipe is maintained below 5 meters per second.

7. The method according to claim 3, wherein a velocity of gas traveling through the mist eliminator pipe is maintained below 3 meters per second.

8. The method according to claim 3, further comprising providing a plurality of baffles within the heating gas passageway to direct the heated gas across the at least one tube as the heated gas flows from the gas inlet to the gas outlet, wherein said plurality of baffles are spaced to maintain a maximum velocity of heated gas flow at greater than 3 meters per second.

9. The method according to claim 8, wherein said plurality of baffles are spaced to maintain the maximum velocity of heated gas flow at greater than 6 meters per second.

10. A method of generating steam comprising: providing a fluid flowing from a lower drum through at least one tube to an upper drum; providing a heated gas flowing from a gas inlet of a heating gas passageway to a gas outlet of the heating gas passageway such that the heated gas contacts the at least one tube and heats the fluid within the at least one tube from liquid-phase to gaseous-phase, wherein the fluid flows through the at least one tube in a substantially counter-current direction to an overall flow path of the heated gas flowing from the gas inlet of the heating gas passageway to the gas outlet of the heating gas passageway, further comprising: providing a second fluid flowing from a second lower drum through at least one second tube to the upper drum; providing a second heated gas flowing from a second gas inlet of a second heating gas passageway to a second gas outlet of the second heating gas passageway such that the second heated gas contacts the at least one second tube and heats the second fluid within the at least one second tube from liquid-phase to gaseous-phase, wherein the second fluid flows through the at least one second tube in a substantially counter-current direction to an overall flow path of the second heated gas flowing from the second gas inlet of the second heating gas passageway to the second gas outlet of the second heating gas passageway.

11. The method according to claim 10, wherein the upper drum is connected to the lower drum via the at least one tube and is connected to the second lower drum via the at least one second tube in an inverted V-shaped configuration.

12. A method of super heating steam comprising: providing an economizer having a fluid flowing within at least one economizer pipe from an economizer fluid inlet to an economizer fluid outlet; providing a evaporator having a lower drum connected through at least one tube to an upper drum, where the lower drum receives the fluid from the economizer fluid outlet, and the fluid flows from the lower drum through the at least one tube to the upper drum; providing a superheater having at least one superheater pipe with a superheater fluid inlet and a superheater fluid outlet, where the superheater fluid inlet receives the fluid from the upper drum of the evaporator; and providing a heated gas flowing through a heating gas passageway extending through the superheater, the evaporator, and the economizer, such that the heated gas contacts the at least one superheater pipe, the at least one tube, and the at least one economizer pipe, wherein the fluid flows through the at least one tube of the evaporator in a substantially counter-current direction to an overall flow path of the heated gas flowing through the evaporator.

13. The method according to claim 12, wherein a cross sectional flow area through the at least one superheater pipe is smaller than a cross sectional flow area through the at least one tube.

14. The method according to claim 13, wherein the fluid flows through the at least one economizer pipe in a substantially counter-current direction to an overall flow path of the heated gas flowing through the economizer.

15. The method according to claim 12, wherein a cross sectional flow area through the at least one economizer pipe is smaller than a cross sectional flow area through the at least one tube.

16. The method according to claim 12, wherein the fluid flows through the at least one superheater pipe in a substantially counter-current direction to an overall flow path of the heated gas flowing through the superheater.

17. The method according to claim 12, wherein the fluid flows through the at least one economizer pipe in a substantially counter-current direction to an overall flow path of the heated gas flowing through the economizer.

18. The method according to claim 12, wherein: the evaporator has a second lower drum connected through at least one second tube to the upper drum, where the second lower drum receives the fluid from the economizer fluid outlet, which fluid flows from the second lower drum through the at least one second tube to the upper drum; the heated gas contacts the at least one second tube as the fluid flows through the evaporator; and the fluid flows through the at least one second tube of the evaporator in a substantially counter-current direction to the overall flow path of the heated gas flowing through the evaporator.

19. The method according to claim 18, wherein the upper drum is connected to the lower drum via the at least one tube and is connected to the second lower drum via the at least one second tube in an inverted V-shaped configuration.

20. The method according to claim 19, wherein: the superheater is provided below the inverted V-shaped configuration of the evaporator; and the economizer is provided above the inverted V-shaped configuration of the evaporator.

21. The method according to claim 18, wherein the fluid flows through the at least one superheater pipe in a substantially counter-current direction to an overall flow path of the heated gas flowing through the superheater, and wherein the fluid flows through the at least one economizer pipe in a substantially counter-current direction to an overall flow path of the heated gas flowing through the economizer.

* * * * *